United States Patent [19]

Opprecht et al.

[11] 4,249,476

[45] Feb. 10, 1981

[54] APPARATUS FOR APPLYING A PROTECTIVE COATING TO THE WELDED SEAM OF A CAN BODY OR THE LIKE

[76] Inventors: Paul Opprecht, Im hintern Bernold, 8962 Bergdietikon; Siegfried Frei, Schoeckstrasse, 3, 9008 St. Gallen, both of Switzerland

[21] Appl. No.: 903,072

[22] Filed: May 5, 1978

[30] Foreign Application Priority Data

May 23, 1977 [CH] Switzerland ..... 6336/77

[51] Int. Cl.[3] ..... B05C 7/08

[52] U.S. Cl. ..... 118/204; 118/224; 118/261; 118/DIG. 10; 118/215

[58] Field of Search ..... 118/215, 214, 224, 261, 118/254, DIG. 10, 204; 427/230

[56] References Cited

U.S. PATENT DOCUMENTS

| | | | |
|---|---|---|---|
| 2,622,557 | 12/1952 | Marcantel | 118/261 X |
| 2,634,703 | 4/1953 | Johns | 118/72 |
| 2,685,861 | 8/1954 | Webb | 118/215 |

FOREIGN PATENT DOCUMENTS

| | | | |
|---|---|---|---|
| 407149 | 9/1944 | Italy | 118/214 |

*Primary Examiner*—John P. McIntosh
*Attorney, Agent, or Firm*—Werner W. Kleeman

[57] ABSTRACT

An apparatus for applying a protective coating to the inside of the welded seam of cans. When fabricating cans which are provided at their inner surface with a protective coating it is necessary, following the welding operation, to apply to the region of the welding seam the then missing part of the protective coating. Prior techniques were unable to achieve any optimum application of the seam-coating which would reliably cover the welded seam. If the fabricated cans are particularly intended for use for canned foods this then is dangerous to the health of the user. With the apparatus of the invention the protective coating is applied by means of a driven applicator roll to the welded seam. By suitably selecting the outer or jacket surface of the roll and a scraper as well as the rotational speed of the roll it is possible to optimize application of the protective coating.

13 Claims, 9 Drawing Figures

FIG. 2
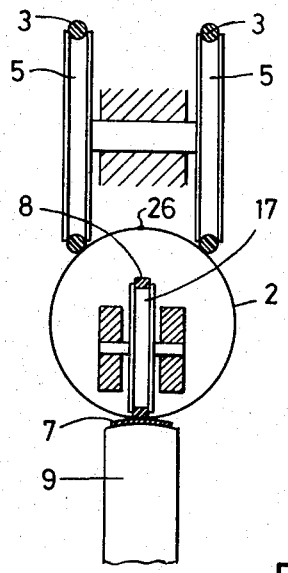
FIG. 3
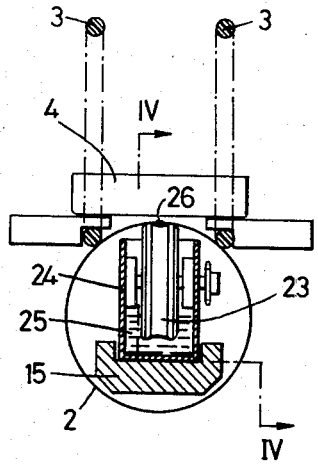
FIG. 4
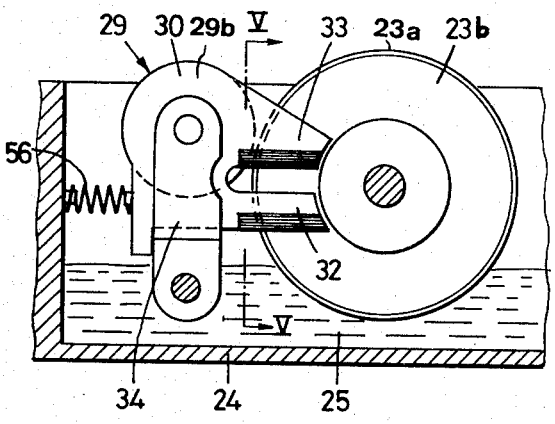
FIG. 5
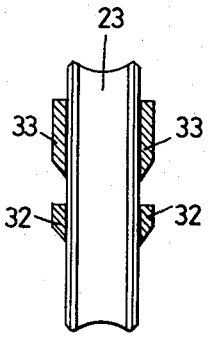
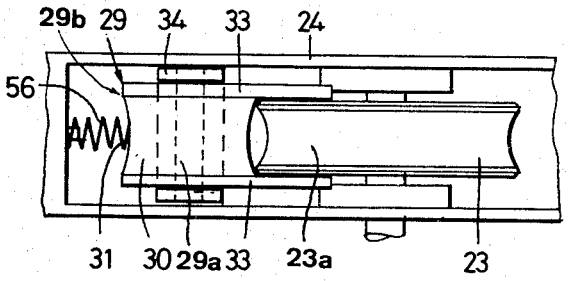
FIG. 6

APPARATUS FOR APPLYING A PROTECTIVE COATING TO THE WELDED SEAM OF A CAN BODY OR THE LIKE

BACKGROUND OF THE INVENTION

The present invention relates to a new and improved construction of apparatus for the application of a protective coating to the welded or soldered seam of can bodies.

Generally speaking, the apparatus of the present invention is of the type comprising a first device for feeding or conveying the can bodies along a path of travel and a second device arranged along the center line of such path of travel. The second device comprises at least one roll or roller which is partially immersible in a coating mass for applying such coating mass to the inner surface or inside of the welded seam.

Present day technology concerned with surface protection of cans against corrosion effects applies a protective layer, for instance a lacquer layer, by rolling such on to the uncut plates. After the cutting of the blanks from such lacquer-coated plates there are formed the can bodies. To achieve a faultless welding of the seam the part of the sheet metal of the can body at the region of the seam is devoid of any protective layer. Following the welding operation these bare portions of the can bodies likewise must be covered with a lacquer coating.

With conventional techniques this is accomplished by spraying the protective lacquer by means of a spray gun. With this method, during the spraying operation, additional air is entrapped beneath the lacquer coating so that during the drying operation there can thus form pores in the protective coating. Optimum covering of the welded seam is particularly then of paramount importance when filling the cans with foodstuffs, to thus prevent any danger of food poisoning.

According to another operating procedure the lacquer is applied to the welded seam by means of an applicator roll driven by the cans. Here, however, there is needed a large contact pressure between the cans and the applicator roll, in order to sufficiently place into rotation such applicator roll. This, in turn, can have adverse effects upon the lacquer coating of the welded seam. If no cans are fed then the lacquer applicator roll is stationary and the lacquer dries-up. This effect equally is unfavorable for the subsequent application of the protective coating. A further drawback which has been found when practicing this method is that the first number of cans which are processed are only partially provided with a lacquer coating and therefore must be rejected. This, in turn, requires sorting operations which obviously increase production costs.

SUMMARY OF THE INVENTION

Hence, with the foregoing in mind, it is a primary object of the present invention to provide a new and improved construction of apparatus for applying a protective coating to the welded seam of a can body or the like in a manner not associated with the aforementioned drawbacks and limitations of the prior art equipment discussed above.

Another and more specific object of the present invention aims at providing a new and improved construction of apparatus by means of which there can be obtained as optimumly as possible a crescent-shaped application of a protective coating to the welded seam of the can bodies or the like, which both satisfies the requirements of the foodstuff or food packaging industry and improves upon the total optical impression of the covering of the welded seam.

Yet a further significant object of the present invention aims at the provision of an improved apparatus for applying a protective coating to the welded seam of a can body or the like which enables utilizing a quick-drying protective coating, especially, a quick-drying lacquer.

A further significant object of the present invention is to provide a new and improved construction of apparatus for applying a protective coating to the welded seam of a can body or container body or the like, which apparatus is relatively simple in construction and design economical to manufacture, extremely reliable in operation, not readily subject to breakdown or malfunction, requires a minimum of maintenance and servicing, while affording highly dependable, accurate and fast application of the protective coating to the welded seam.

Now in order to implement these and still further objects of the invention, which will become more readily apparent as the description proceeds, the coating applying apparatus of the present development is manifested by the features that the second device incorporates means for driving the applicator roll.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a longitudinal sectional view through a first exemplary embodiment of apparatus for applying a protective coating in the form of a lacquer to the welded seam of a can body or the like;

FIG. 2 is a cross-sectional view through the feed device for the can bodies and the drive of the applicator roll, which cross-sectional view is taken substantially along the line II—II of FIG. 1;

FIG. 3 is a cross-sectional view through the lacquer container or vat, taken substantially along the line III—III of FIG. 1;

FIG. 4 is a longitudinal sectional view through the lacquer container, taken substantially along the line IV—IV of FIG. 3;

FIG. 5 is a cross-sectional view, taken substantially along the line V—V of FIG. 4;

FIG. 6 is a fragmentary top plan view of the lacquer container equipped with scraper means and lacquer applicator roll;

DETAILED DESCRIPTION OF THE PREFERRED EMBODIMENTS

Figure 1:
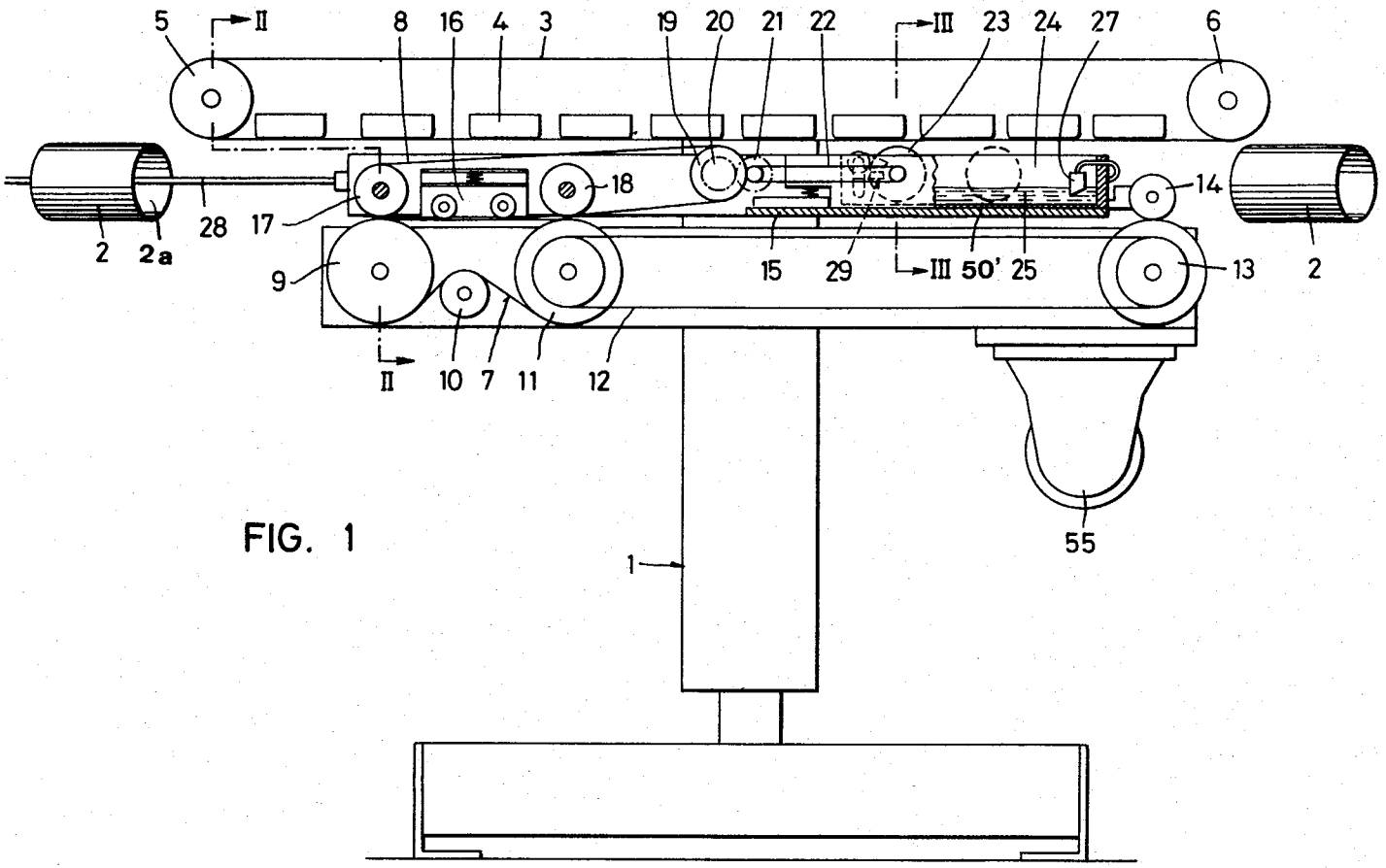

Describing now the drawings it is to be understood that only enough of the apparatus for applying a protective coating to the welded seam of a can body or the like has been shown therein as will enable those skilled in the art to readily understand the underlying principles and concepts of the present invention. Turning attention to FIG. 1 there is shown therein in longitudinal sectional view the entire protective coating-applicator apparatus used for applying a lacquer protective coating, together with the support or frame structure 1. The can or container bodies 2 or the like—hereinafter simply referred to as can bodies—are infed from a not particularly illustrated welding machine to the lacquer apparatus of FIG. 1. Welding machines for producing a welded seam at can bodies are well known in the art and since details thereof are unimportant for the understanding of the invention it is unnecessary to further consider the same here. It can be assumed that any suitable welding machine capable of producing a welded seam can be employed in conjunction with the lacquer applicator equipment shown in FIG. 1. Equally any suitable protective coating, such as the mentioned lacquer can be used. Typically, such lacquer may be, for instance, a colored or colorless modified epoxy lacquer with at least 50 percent solids content. Now in order to ensure that the welded seam 26 (FIG. 3) of the can bodies 2 remains exactly in the desired position, following completion of the welding operation, the can bodies 2 are laterally guided, for instance by means of two magnetic bands or belts until they reach the operable zone of the lacquer applicator apparatus. In such lacquer applicator apparatus or equipment as shown in FIG. 1 the welded can bodies 2 are fed therethrough at the top of such can bodies by means of suitable traction means, such as the endless round belts 3. The endless round belts 3 are equipped with magnets 4 arranged above the can bodies 2 and retain the latter in firm contact with the revolving endless round belts or belt means 3. The revolving endless round belts 3 are trained about respective pairs of rolls 5 and 6, for instance as shown in FIG. 2 for the pair of rolls 5. The revolving endless round belts 3 can be driven at either one of the pairs of rolls 5 and 6 by any suitable drive means (not shown). By means of a flat belt 7 there is driven a profile belt 8 arranged above the flat belt 7, these belts 7 and 8 also constituting traction means or elements. The flat belt 7 is guided over the rolls or rollers 9, 10 and 11, and the roll 11 is driven by a roll 13 through the intermediary of a belt 12. A drive motor 55 drives the roll 13. A lacquer tubular part 15 is supported by a roll 14. The transport or feed velocities of the round belts 3 and the flat belt 7 are the same.

Figure 7:
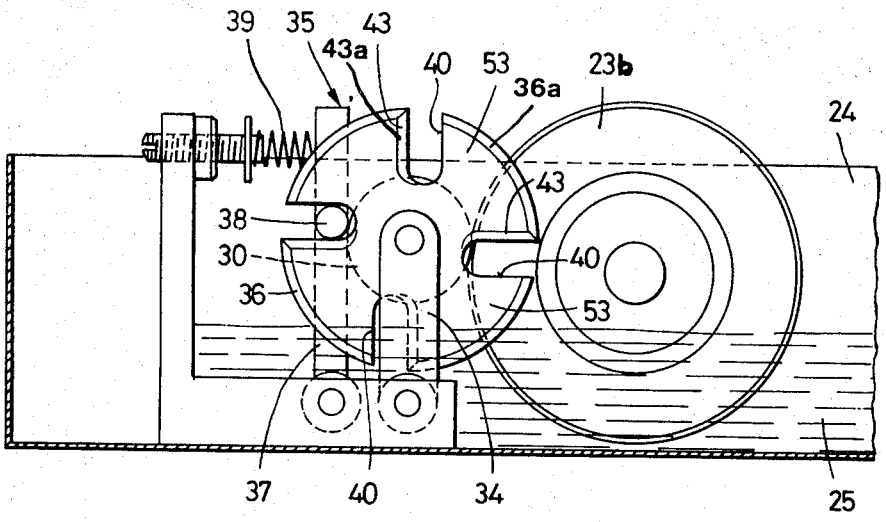
FIG. 7 is a longitudinal sectional view through a lacquer container according to a second exemplary embodiment of the invention.

The lacquer tubular part 15 together with the profile belt drive 8 resiliently bear upon the flat belt 7. As a result, there is ensured that the profile belt 8 also then will be driven by the flat belt 7 when a can body 2 has passed this part of the lacquer applicator apparatus. The resilient contact of the profile belt 8 against the flat belt 7 is accomplished by the press or contact means 16. The profile belt 8 is guided over the rolls 17, 18 and 19. At the roll 19 there is located a concentrically arranged gear 20 meshing with a gear 21. A chain 22 mounted at the gear 21 drives the lacquer applying or applicator roll 23 having an outer surface **23*a* (FIGS. 4 and 6) and side surfaces or faces 23*b* (FIGS. 4 and 7). By means of the gearing 20 and 21 there is accomplished a change in the rotational direction so that the lacquer applicator roll 23 is moved in the same direction as the can body 2. By changing the gears 20 and 21 it is possible to vary the rotational speed of the lacquer applicator roll 23. It has however been found in practice that optimum lacquer application can be then attained if the lacquer applicator roll 23 has approximately the same surface speed as the transported can bodies 2**.

Continuing, now in FIG. 2 there is illustrated in cross-sectional view the device for conveying the can bodies 2 as well as the drive of the profile belt 8 by means of the flat belt 7. FIG. 3 is a cross-section through the lacquer container 24 and the applicator roll 23. By means of the applicator roll 23 the protective coating material, here the lacquer, is removed from the lacquer bath 25 and applied to the inner surface or inside of the welded seam 26 of the can bodies 2. The applicator roll 23 is preferably fabricated from a material affording good adherance of the lacquer. By means of a feeler head 27 it is possible to regulate the level of the lacquer bath 25 with the aid of any suitable control, such as a pneumatic logic control located externally of the lacquer applicator apparatus, i.e., the lacquer container 24. The infeed of the lacquer is accomplished by means of the infeed line or conduit 28 (FIG. 1).

The drive of the applicator roll 23 by means of the profile belt 8 and the chain 22 must be accomplished within the cylinder **2*a* formed by the throughpassing can bodies 2. By means of this drive technique there is ensured that even cans having a small diameter can be provided with the lacquer coating. At the end of the lacquer applicator apparatus, following the application of the lacquer protective coat to the welded seam, the can bodies 2 are guided by the rolls 13 and 14. These rolls 13 and 14 also ensure for good contact of the lacquer tubular part 15** at this end of the equipment.

Now in the description to follow there will be discussed on the basis of FIGS. 4 to 8 the lacquer application operation as well as the actual lacquer applicator apparatus. According to a first exemplary embodiment of lacquer applicator apparatus there is mounted in the lacquer container or vat 24 a scraper means or scraper device 29 opposite the lacquer applicator roll 23. This scraper device or means 29 comprises, for instance, a rotationally symmetrical body or body member **29*a*. The outer surface or jacket 31 of this body 29*a* is of concave configuration. The scraper device 29 will be seen to have a lower scraper element or scraper 32 and an upper scraper element or scraper 33. Between these arm-like scrapers 32 and 33 there can escape any excess lacquer material, so that there does not occur too thick application of the lacquer at the welded seam 26 of the can bodies 2. The scraper device 29 is secured against rotation by anti-rotation securing means 34 and pressed under the action of a suitable resilient element or other appropriate means, here shown in the form of a spring 56, against the lacquer applicator or applying roll 23**.

The lacquer container 24 is resiliently arranged in order to be able to compensate for irregularities in the can bodies. By suitably selecting the shape or profile of the outer or jacket surface of the intermediate part **29*b* of the scraper device 29 and the outer surface or jacket 23*a* of the applicator roll 23 as well as the rotational speed of such applicator roll, it is possible to optimize the shape and thickness of the lacquer layer applied to the welded seam 26**.

Figure 8:
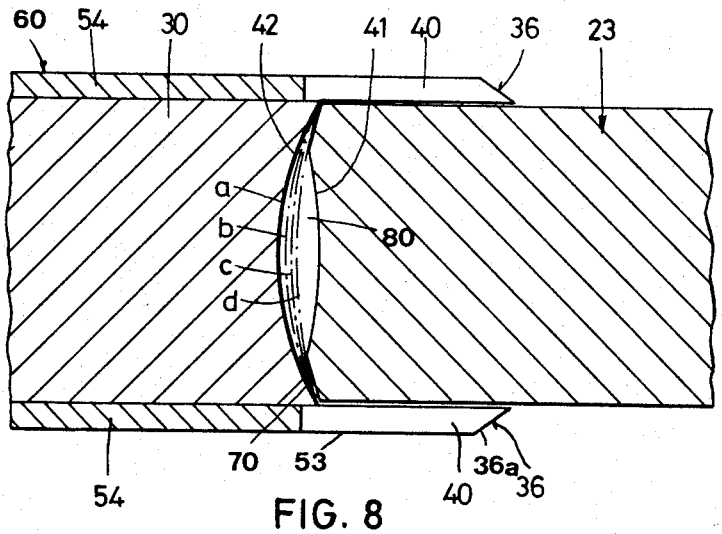
FIG. 8 is a cross-sectional view through the scraper means or scraper and lacquer applicator roll of the second embodiment of the invention shown in FIG. 7.

According to a second exemplary embodiment as shown in FIGS. 7 and 8, the scraper or stripper device, generally indicated by reference character 60, is provided at its intermediate portion or part 30 with lateral, substantially circular-shaped disks 54. These disks 54 are provided with, for instance, four slots 40, forming pairs of laterally spaced arms 53 straddling the applicator roll 23. The edge 36 of each of these disks 54 and, equally, each respective lateral edge 43 of the slots 40 are provided with bevelled portions of bevels 36a and 43a respectively. By means of a contact or pressure-exerting means 37 having a bolt 38 engaging into any given desired ones of the slots 40 which are aligned with one another at the disks 54, it is possible to secure the scraper device 60 in four different positions. The contact pressure is exerted by means of a spring 39 or equivalent structure. The intermediate or central part 30 of the scraper device 60 has four regions having four different surface curvatures a, b, c and d. In FIG. 8 these four curvatures have been shown in phantom or dash-dot lines. Upon retraction of the pressure-exerting or press means 37 it is possible to selectively index or rotate the scraper device 60 and to lock such in a different one of the four positions by means of the bolt 38.

By selecting one of the four curvatures a, b, c and d it is possible to alter the shape of the applied lacquer coat at the welded seam 26. By means of the bevelled portions 36a and 43a it is possible to improve the scraping action.

The applicator roll 23 has points of contact 70 with the intermediate part 30 of the scraper means 60 which are disposed adjacent an intermediate space 80 between both arm members 53 of such scraper means.

Figure 9:
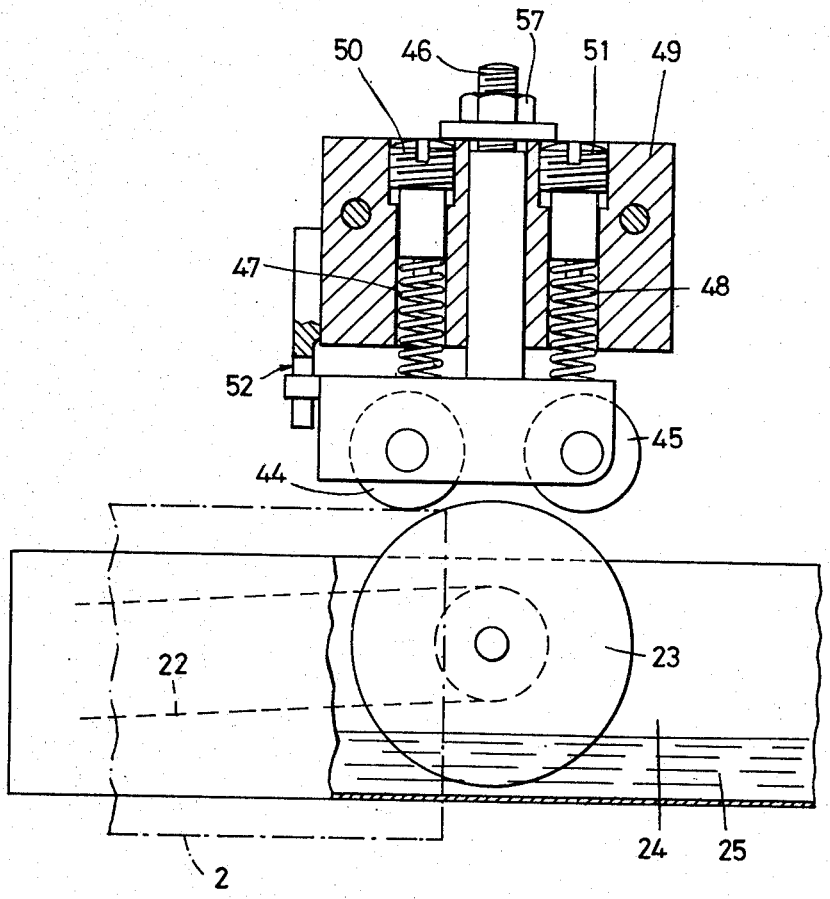
FIG. 9 is a longitudinal sectional view through the lacquer container and the contact or press means of a further exemplary embodiment of the invention.

In order to compensate for the undesired effect of irregularities at the cans or the like, and to maintain a defined contact pressure when the lacquer container or vat 26 is stationary, then, as best seen by referring to FIG. 9, there is additionally applied to the can body 2 at the region of the lacquer applicator roll 23 a force of about 0.1 to 0.5 Kp by means of two rolls or rollers 44 and 45. The stroke of about 1 mm can be adjusted by means of a nut 57 or equivalent structure. The pressure which is applied to the rolls 44 and 45 is exerted by means of two resilient elements, here shown as the springs 47 and 48 which are guided within a block 49 and arrested by two screws 50 and 51 or equivalent structure. An arresting mechanism 52 secures the block 49 against rotation.

During application of the lacquer coating to large size cans it would be possible to also employ, instead of the above-described drive, a motor arranged adjacent the applicator roll for driving the same.

Equally, it would be possible to arrange in succession a number of applicator rolls, such as schematically indicated in phantom lines in FIG. 1 for the further roll 50. The spacing between two tandomly arranged applicator rolls, such as the rolls 23 and 50', then could be selected such that the first protective coating has already dried when the processed can body has reached the next successive applicator roll. This is an advantage in terms of the adherence of the next applied protective coating. The drying of the protective coating could be accelerated, for instance, by employing a heating device between two applicator rolls.

The above-described apparatus constructions enable applying a protective coating to the inner surface of the welded seam of can bodies, to thereby effectively protect the contents of the cans, particularly when used in the food industry, from coming into contact with the welded seam. In this way there can be avoided any possibility of corrosion and therefore also any contamination danger of the contents of the can.

While there are shown and described present preferred embodiments of the invention, it is to be distinctly understood that the invention is not limited, but may be otherwise variously embodied and practiced within the scope of the following claims. ACCORDINGLY,

What is claimed is:

1. An apparatus for applying a protective coating to a seam, such as a welded or soldered seam, of can bodies, comprising:

a first device for feeding the can bodies along a predetermined path of travel;

a second device arranged approximately along a center line of said path of travel;

means containing a mass of material for forming the protective coating;

said second device comprising at least one applicator roll which is at least partially immersible in said coating mass for the application of the coating mass to the inside of said seam;

said second device comprising means for driving said applicator roll;

said driving means comprising: a plurality of rolls; an endless first traction element guided about said plurality of rolls;

said driving means further including means for rotatably connecting said applicator roll with one of said plurality of rolls;

a second motor-driven endless traction element arranged neighboring said path of travel;

said first and second traction elements having parts thereof extending essentially parallel to one another in order to transmit the movement of the second traction element to said first traction element; and wherein, the movement transmission is accomplished by direct contact of the traction elements or an intermediately situated wall of one of the cans.

2. The apparatus as defined in claim 1, further including:

means for pressing together said essentially parallelly extending parts of the traction elements.

3. An apparatus for applying a protective coating to a seam, such as a welded or soldered seam, of can bodies having a small diameter, comprising:

a frame structure;

transport means for feeding the can bodies in a continuous straight line along a predetermined path of travel;

a device arranged approximately along a center line of said path of travel;

means for mounting said device between said transport means and said frame structure;

means, being arranged inside of the can bodies, for containing a mass of material for forming the protective coating;

said device including at least one applicator roll which is at least partially immersible in said coating mass for the application of the coating mass to the seam inside of each of said can bodies;

said device further including drive means, being connected inside of said can bodies to the applicator roll, for positively driving said applicator roll continuously at least during application of the coating mass to said seam; and said drive means having a first traction element arranged inside of said can bodies and a second traction element arranged outside of said can bodies;

whereby movement transmitted to the applicator roll is accomplished by direct contact of said first and second traction elements or through an intermediately situated wall of one of the can bodies.

4. The apparatus as defined in claim 3, wherein:

said applicator roll has an outer surface and side surfaces; and scraper means partially enclosing said outer surface and side surfaces of said applicator roll.

5. The apparatus as defined in claim 4, wherein:

said scraper means has lateral portions each composed of a pair of spacedly arranged arm members for stripping excess coating mass from the applicator roll.

6. The apparatus as defined in claim 4, wherein:

said scraper means comprises an intermediate portion coacting with the outer surface of the applicator roll;

said intermediate portion having a jacket surface possessing at least two regions having different curvature; and each said region having operatively associated therewith two pairs of arms arranged laterally in spaced relationship from one another for scraping the side surfaces of the applicator roll.

7. The apparatus as defined in claim 3, wherein:

said applicator roll has an outer surface and an intermediate portion; and the outer surface of the applicator roll has at its intermediate portion a curved portion and at its peripheral region a curvature which is essentially matched to the curvature of the processed cans.

8. The apparatus as defined in claim 3, wherein:

said applicator roll has an outer surface; and the outer surface of the applicator roll has an intermediate portion having a concave curvature viewed from the exterior of said applicator roll in the direction of said outer surface and at its peripheral region a curvature which is matched to the curvature of the processed cans.

9. The apparatus as defined in claim 3, further including:

contact means arranged above said applicator roll for producing a substantially adjustable constant contact pressure of the can having a welded seam against the applicator roll.

10. The apparatus as defined in claim 3, further including:

at least two applicator rolls arranged behind one another in succession.

11. The apparatus as defined in claim 3, wherein: said mounting means comprises at least one guide roll for guiding the can bodies along the center line of said path of travel.

12. The apparatus as defined in claim 3, wherein: said driving means drives said applicator roll at a speed different than the speed of transport of the can bodies.

13. The apparatus as defined in claim 3, wherein: said mounting means resiliently mounts said device.

* * * * *